US005083523A

United States Patent [19]

Osborne-Moss et al.

[11] Patent Number: 5,083,523

[45] Date of Patent: Jan. 28, 1992

[54] EXTERNAL PRESSURE VESSEL FRAMING

[76] Inventors: David M. Osborne-Moss, Technology Transfer Centre, Silwood Park, Buckhurst Road, Ascot, Berkshire, 7PW; Phillip A. Abbott, Woodville, Kildary,, Rossshire, both of United Kingdom

[21] Appl. No.: 476,404

[22] PCT Filed: Oct. 10, 1988

[86] PCT No.: PCT/GB88/00840

§ 371 Date: May 29, 1990

§ 102(e) Date: May 29, 1990

[87] PCT Pub. No.: WO89/03337

PCT Pub. Date: Apr. 20, 1989

[30] Foreign Application Priority Data

Oct. 8, 1987 [GB] United Kingdom ..... 8723599

[51] Int. Cl.[5] ..... B65D 88/78

[52] U.S. Cl. ..... 114/256; 114/292

[58] Field of Search ..... 114/312, 313, 321, 256, 114/257, 265, 266, 267, 292; 405/210; 220/5

[56] References Cited

U.S. PATENT DOCUMENTS

| | | | |
|---|---|---|---|
| 1,575,226 | 3/1926 | Pichler | 114/312 |
| 3,823,563 | 7/1974 | Lovie . | |
| 4,155,671 | 5/1979 | Vos | 405/210 |
| 4,570,678 | 2/1986 | Ziemek et al. | 138/113 |

FOREIGN PATENT DOCUMENTS

| | | |
|---|---|---|
| 0009105 | 4/1980 | European Pat. Off. . |
| 0235576 | 9/1987 | European Pat. Off. . |
| 1543650 | 4/1979 | United Kingdom . |
| 1598551 | 9/1981 | United Kingdom . |

*Primary Examiner*—Jesus D. Sotelo

*Attorney, Agent, or Firm*—Flynn, Thiel, Boutell & Tanis

[57] ABSTRACT

The present invention relates to a structural form consisting of a hollow member (48) with alternate convex (32) and unstiffened concave (34) surfaces and an internal framing arrangement (36) required to support such a structure such that it is capable of resisting external pressure. This structural configuration reduces the weight and simplifies the construction of such structures in relation to conventional stiffened fixed curvature cylindrical external pressure vessels. Use of such forms is envisaged particularly where external pressure is the dominant loading, for example in the offshore marine and subsea environments.

21 Claims, 6 Drawing Sheets

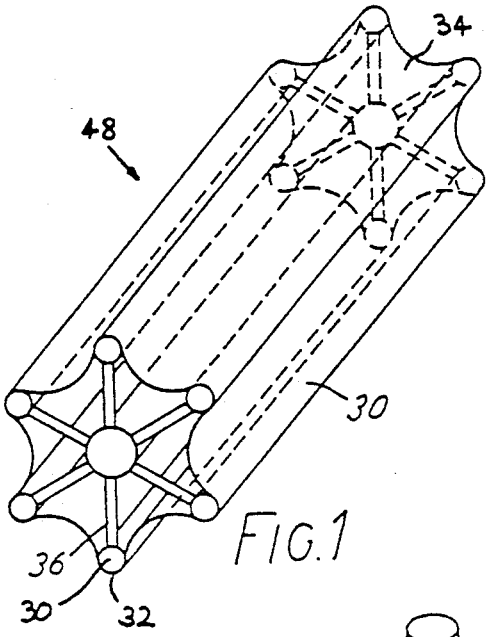
FIG. 1
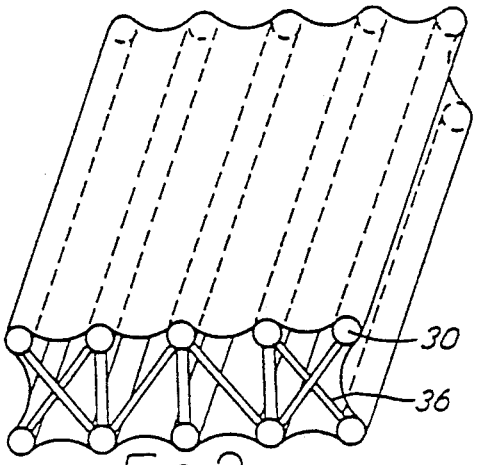
FIG. 2
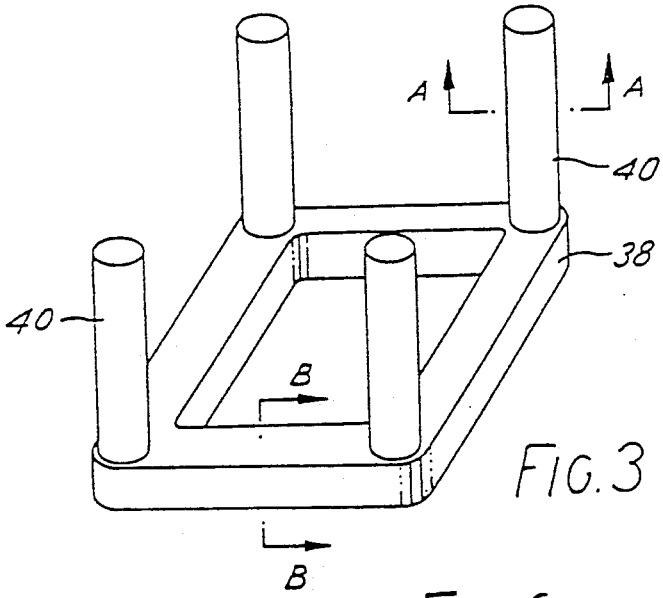
FIG. 3
FIG. 4
AA
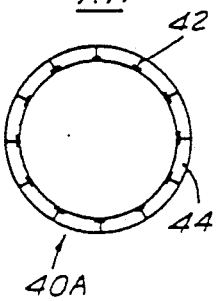
FIG. 5
BB
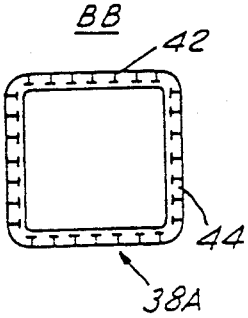
FIG. 6
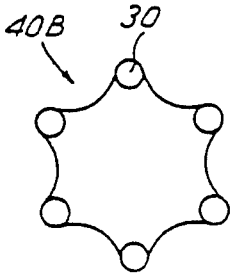
FIG. 7
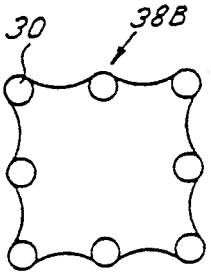

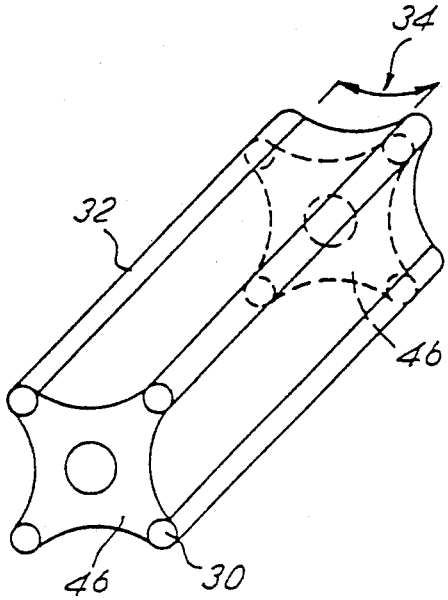
FIG. 8
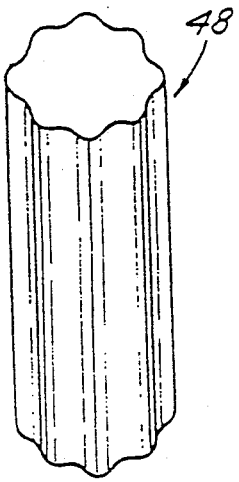
FIG. 9
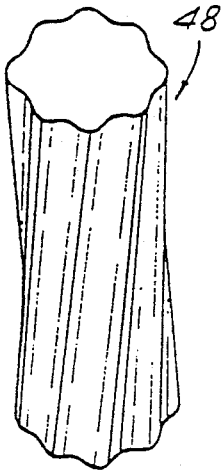
FIG. 10
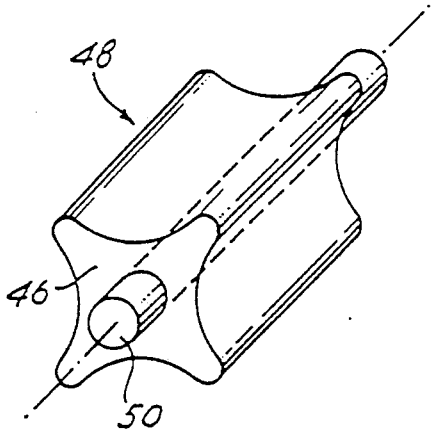
FIG. 11
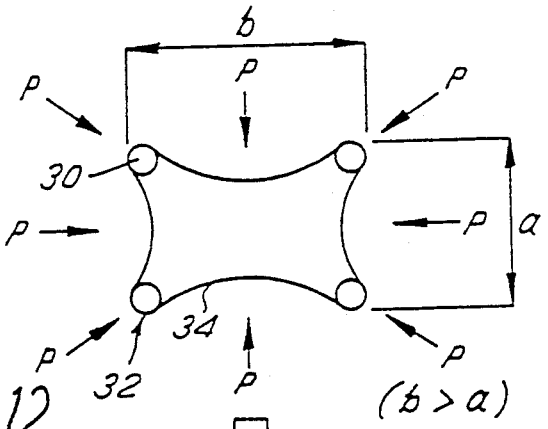
FIG. 12
FIG. 13
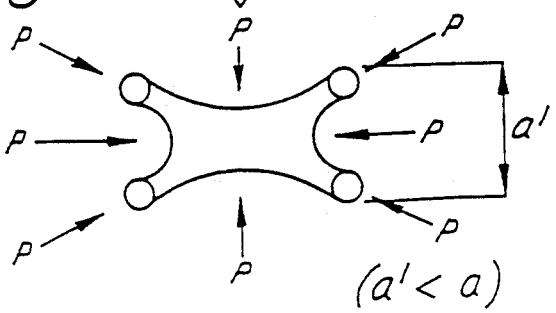

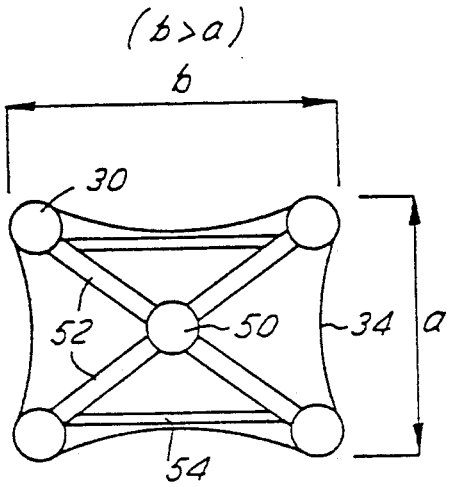
FIG. 14
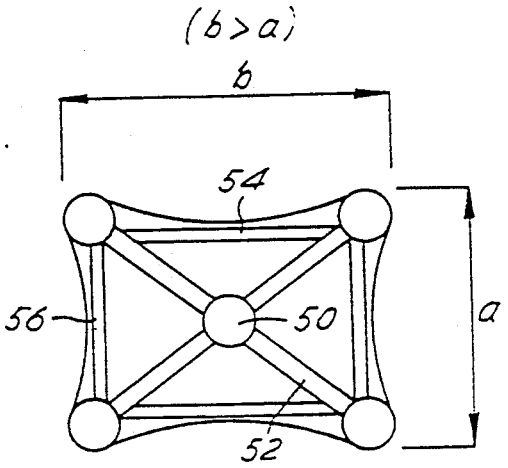
FIG. 15
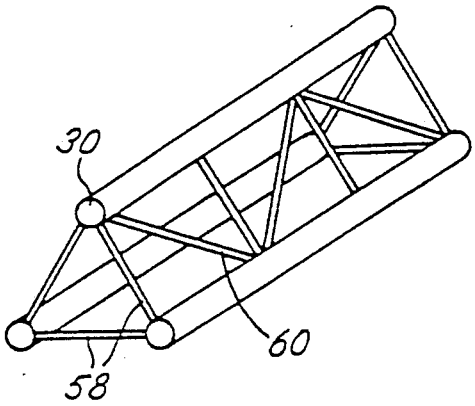
FIG. 16
FIG. 17
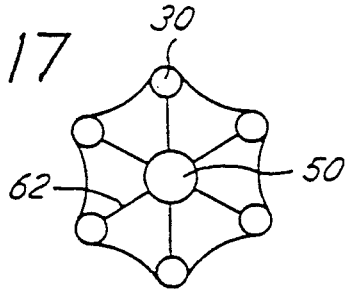
FIG. 18
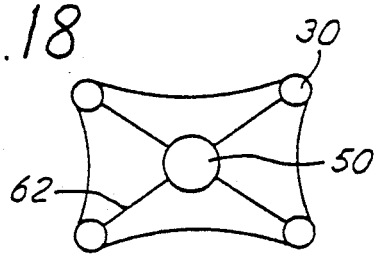

FIG. 19
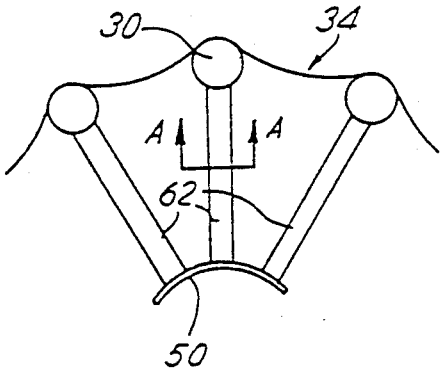
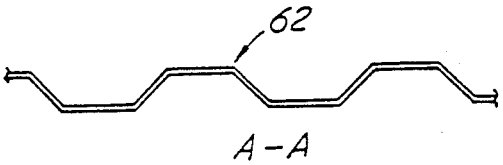
FIG. 20
FIG. 21
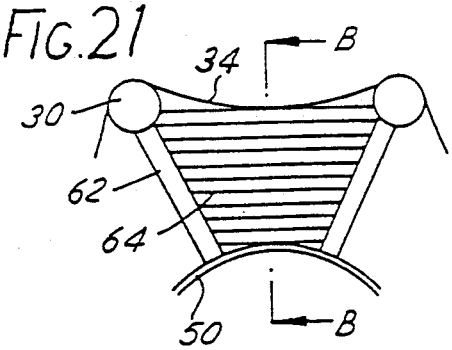
FIG. 22
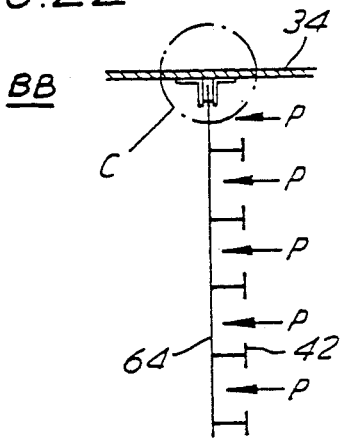
FIG. 25
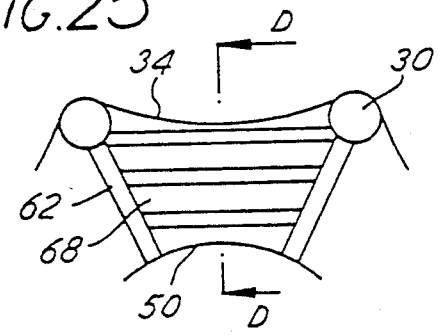
FIG. 23
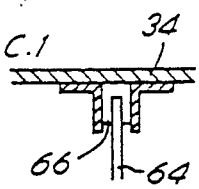
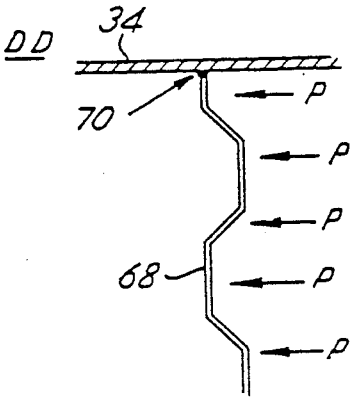
FIG. 26
FIG. 24
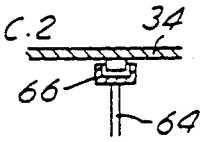

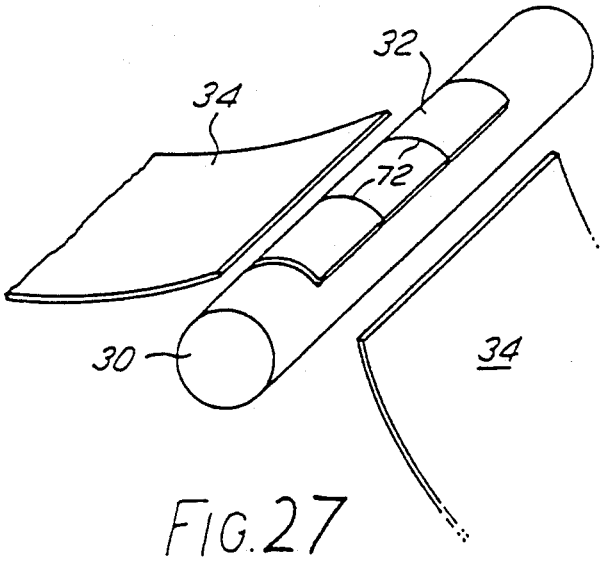
FIG. 27
FIG. 32
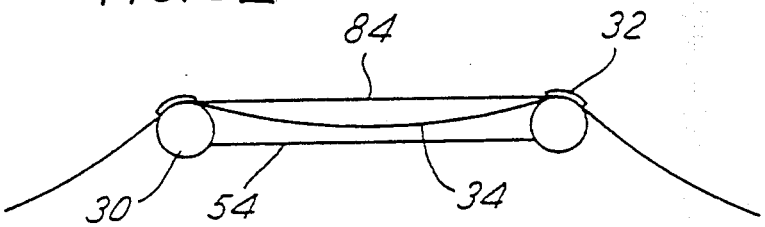
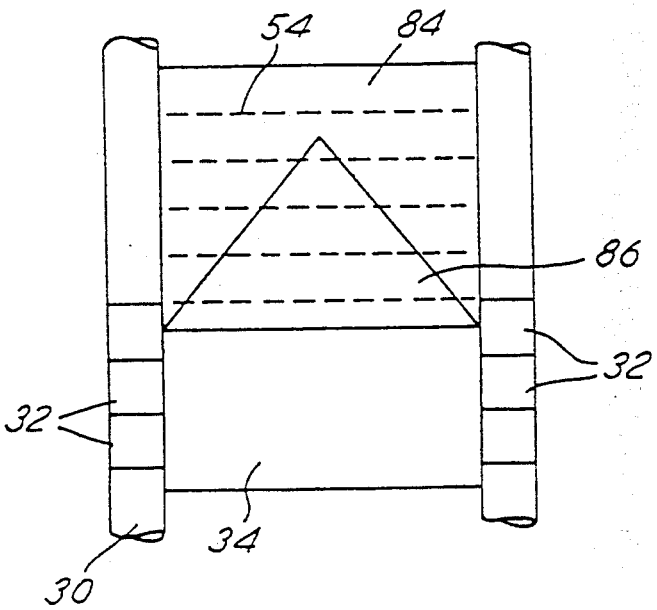
FIG. 33

EXTERNAL PRESSURE VESSEL FRAMING

In the offshore oil business floating structures such as semi-submersibles and tension leg platforms (TLP's) are sometimes used to support drilling and/or production equipment. These structures are very weight sensitive in that the less structural steel content used the more equipment payload can be carried. A major structural steel weight component is the outer shell of the columns and pontoons which are usually circular or rectangular in cross section and consist of plate circumferentially or longitudinally stiffened with T stiffeners or bulb flats at close centres. Such a form of construction is both expensive and time consuming to construct to the fine tolerances required due to the load capacity sensitivity of compression shells to imperfections.

Both TLP's and semi-submersibles have hull pontoons and columns which are prismatic elements which may have circular, square, rectangular, hexagonal or other shapes in cross section. In order to resist the hydrostatic pressure around these elements when they are submerged the external shell plating is stiffened by transverse stiffeners and/or longitudinal stiffeners located inside the shell plating to prevent the plate from buckling.

Since this stiffening is very labour intensive to fabricate and adds both cost and weight to the hull it would be of great benefit to eliminate it altogether. Furthermore, it would be of benefit to configure the external plating in such a way that it is not subjected to bending stresses at all and therefore cannot buckle. By so doing, the external plating can also be made lighter than it would be as presently configured in today's floating structures.

It is the purpose of this invention to eliminate the requirement for stiffeners and to lighten the external shell plating on both pontoon and column elements.

In accordance with the present invention there is provided a structural form comprising a hollow member having a shell with alternate concave and convex surfaces relative to the longitudinal axis of the member and an internal framing arrangement to support the shell, characterised in that the concave surfaces are unstiffened and run substantially the whole of the length of the member, the member being capable of resisting an applied pressure loading.

This structural configuration will reduce the weight and cost of such structures when compared with conventional stiffened fixed curvature cylindrical external pressure vessels. Such structures will offer advantages over conventional designs particularly where external pressure is the dominant loading, for example in the offshore marine and subsea environments.

This framing invention lends itself to any external pressure vessel and is not restricted to TLP's and semi-submersibles or even to water pressure for that matter. Nor is the idea restricted to steel or any other metal since this invention would lend itself very well to the introduction of carbon fibre technology for the exterior shell material.

External pressure vessles are required wherever people or equipment are required to be kept dry beneath the sea and this framing invention could be used to great advantage in such structures. Examples would include habitats for people, enclosures for offshore oil production equipment, diving vessels, submarines, buoyancy chambers and tanks, etc. There are instances where the corner longitudinal framing tubes could be of additional use e.g. guides for tension leg platform tethers and pile guides for steel offshore jacket buoyancy legs.

This framing invention would also be of advantage in resisting external pressure from ice. Whenever a structure becomes frozen in ice great pressure is exerted by the ice on the structure as the ice expands and this pressure could be resisted very efficiently by the framing invention. In addition where the corner pipes are used to form the convex portions of the shell they could carry steam or other hot gas or fluid to melt the ice local to the structure and thereby reduce the external pressure.

Such shapes have not been used before for offshore vessels due to the increased drag of such a shape in a moving fluid (or when moving through a fluid) but it will be shown that this shape is entirely adequate for a stationary TLP or semi-submersible floating production platform. It is also the case that such a shape is preferable due to its damping characteristics (i.e. the reduction of oscillatory motion) although the extent of this benefit is not determined as yet. It is only relatively recently that floating structures were required to stay on station for long periods of time and were not required to move frequently or rapidly through the water.

The invention will now be described by way of example with reference to the accompanying drawings, in which: FIG. 1 shows a prismatic member constructed in accordance with the present invention;

FIG. 2 shows a rectangular structure constructed in accordance with the present invention;

FIG. 3 represents a hull for a semi-submersible or TLP consisting of column and pontoon elements;

FIGS. 4 and 5 show respective cross sections through the column and pontoon of FIG. 3 constructed using known techniques;

FIGS. 6 and 7 show respective cross sections through the column and pontoon of FIG. 3 constructed using the techniques of the present invention;

FIG. 8 shows a member with transverse stiffening diaphragms attached along its length;

FIGS. 9 and 10 show the spiralling of a prismatic vessel under external pressure (FIG. 9) and in the absence of an end restraint FIG. 10);

FIG. 11 shows the member of FIG. 8 with a concentric internal element;

FIGS. 12 and 13 show the distortion of a rectangular element under the action of external pressure;

FIGS. 14 and 15 show a member having internal framing to prevent the distortion of FIGS. 12 and 13;

FIG. 16 shows an internal framework for prevention of distortion without use of a concentric internal element;

FIGS. 17 to 20 illustrate the positioning and construction of longitudinal bulkheads within the member; FIGS. 21 to 26 illustrate the positioning and construction of stiffened (FIGS. 21 to 24) and corrugated (FIGS. 25, 26) transverse bulkheads within the member;

FIGS. 27 and 28 show the construction of the outer skin of the member;

FIGS. 31 to 33 illustrate the transition from concave membrane to flat plate at the extremity of a member.

Figure 28:
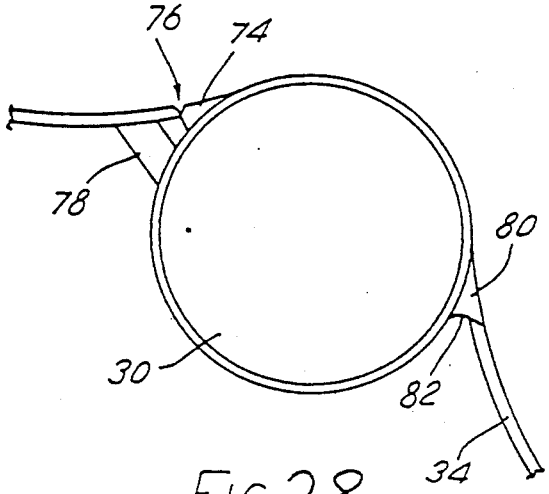

FIG. 1 shows a hollow structural member constructed in accordance with the present invention. It has a number of longitudinal corner tubes 30 with convex corner plating 32 attached thereto. Intermediate each adjacent pair of corner tubes 30 is a section of unstiffened concave span plating 34. Within the member is an internal framework 36 which supports the corner tubes.

The framing invention can also be used for structures which must provide relatively large dry areas in a sub-sea environment. An example is shown in FIG. 2 wherein a large number of parallel pipes 30 form an almost flat roof with concave membrane shell plate 34 between the pipes. Similar framing is used for the floor of the structure. Internal tubular framing 36 supports the pipes 30 which may also be used as service ducting. A typical hull for a semi-submersible or TLP is shown in FIG. 3. It might consist of any number of pontoon 38 or column 40 elements but for simplicity a square closed ring pontoon 38 of four elements with four vertical columns 40 is shown. Cross sections of the column (AA) and pontoon (BB) constructed using known techniques and using T-stiffeners 42 and ring stiffeners 44 are shown in FIGS. 4 and 5 respectively. FIGS. 6 and 7 respectively show the same cross sections of the columns and pontoons using the present invention and showing the simplicity of construction.

To further illustrate the framing technique only a rectangular section is shown in FIG. 8, however, other sections would be framed in a similar manner.

It is anticipated that diaphragms 46 and/or transverse bulkheads would be set up and jigged into the correct relative locations while the corner pipes 30 with cover plates 32 already in position were attached. After two such pipes 30 were attached to the top corners of the diaphragms 46, the concave top shell plating 34 between them would be lowered onto the corner pipes 30 and welded along its edges to the cover plates 32. Full penetration welds would join the shell plate to the cover plates using the corner pipes 30 as back-up and the welding would be done in the downhand position. The entire element would be rotated to attach the other shell plates in a similar manner using downhand welding.

A prismatic external pressure vessel element 48 having both concave 34 and convex 32 surfaces as shown in FIG. 9 could have low torsional stiffness in some cases. It can be expected that in the absence of fixed end restraint such a vessel would undergo a decrease in volume under external pressure by spiralling, i.e. a concave "flute" of the element which is originally straight would spiral under increased pressure as shown in FIG. 10.

The end fixity found when such an element 48 is incorporated into such a structure as a TLP or semi-submersible will tend to resist such distortion but additional resistance can be obtained by utilizing the high torsional resistance of a smaller prismatic element 50 with straight (unfluted) sides coaxial with the larger fluted element as shown in FIG. 11.

It should be noted that such an internal tube is often beneficial in marine vessels since it provides a reserve of buoyancy in the event of water ingress through the outer shell. It is claimed that such a fluted element has not been used in the past precisely because it will tend to spiral under external pressure. In this case the invention is also based on the claim that an inner unfluted tube may be used in conjunction with the external fluted shell as one method of preventing this action.

Considering the case of a rectangle, i.e. a prismatic member with a cross section that is "almost" a rectangle but with concave sides, under the action of the uniform external pressure (P), this element will tend to collapse as shown in FIGS. 12 and 13.

The internal framing must resist this collapse mechanism. Many alternatives are possible, one being shown in FIG. 14 and illustrating the framing (diaphragms) in the form of compression posts 52 and tension struts 54 that could be used between transverse bulkheads. The diaphragm design above would be a minimum requirement to prevent the form of collapse described. An alternative design would add compression posts 56 along the short dimension (a) as shown in FIG. 15.

The transverse diaphragm framing proposed above would not be used if it were not less expensive than using a plated bulkhead, i.e. simply spacing bulkheads closer together.

An inner tube 50 at the axis of the element is not the only method of preventing collapse by spiralling due to insufficient torsional stiffness. Other methods exist for increasing the torsional stiffness of the element sufficiently to prevent such collapse which do not require this central tube and an example is shown for an element having a triangular cross section in FIG. 16.

In this example the torsional stiffness is increased by framing 58 between adjacent pipe corners 30 to make trusses. Diagonal members 60 in these trusses will increase the torsional stiffness of the element sufficiently to prevent spiral collapse. An alternative would be to replace the diagonal members 60 with light plates acting in shear. If the diagonals 60 were left out entirely, some resistance would still be provided because the truss acts as a Vierendeel girder.

Elements having any number of sides could be framed in a similar manner and in each case the internal framing would have to be such that it provided the required torsional stiffness between transverse bulkheads. Framing such as this might be preferred in those sub-sea structures where a central tube is not of advantage in providing reserve bouyancy or it obstructs the passage of people or location of equipment. As an example, portions of the pontoons of a TLP might require a central tube but other portions, such as areas for pump rooms may not. In this example the pump rooms could be framed by forming trusses between adjacent corner pipes as was shown above in FIG. 16.

If the external pressure vessel is part of a floating vessel such as a TLP or semi-submersible then internal bulkheads will be required along the axis of the element as well as transverse to the axis. This division is to limit the volume which is flooded in the event of water ingress through the outer shell and to maintain upright stability. The most desirable framing plan for longitudinal bulkheads 62 would be to place them between the central tube 50 (probably a cylinder in most cases) and the corner pipe beams 30 as illustrated in FIGS. 17 and 18.

The longitudinal bulkheads 62 are best formed from corrugated plate panels and are most ideally located as shown in FIGS. 19 and 20 to support the high compressive forces necessary to prevent the corner pipe beams 30 from bending towards the centre of the element under the action of external pressure. Obviously such bulkheads will have to be corrugated or stiffened to prevent buckling and their use must be kept to a minimum to prevent unnecessary additional weight and expense.

Since longitudinal bulkheads 62 will remove the requirement to design the pipes they support for bending loads they are preferable to transverse bulkheads 64, but they will not limit the need for transverse bulkheads 64 altogether.

Transverse bulkheads 64 must provide a watertight seal where they meet the outer membrane shell 34 but must not provide rigid support for the shell as this would prevent the shell from acting as a simple membrane with single curvature. It is only where a transverse bulkhead 64 meets the outer membrane 34 that there is the potential structural problems. This problem must be overcome by some sort of "sort support". If, however, a transverse bulkhead meets a longitudinal bulkhead or an inner tube, rigid support made by welding a rigid bulkhead to a rigid element is entirely satisfactory.

One method for allowing "soft support" at the outer membrane shell is illustrated in FIGS. 21 to 24.

As water pressure (P) acts upon the outer membrane shell 34 it will tend to compress the elastomeric seal 66 down against the edge of the transverse bulkhead 64. As water pressure (P) acts against one side of the transverse bulkhead 64 the elastomeric seal 66 will compress on the opposite side thus helping the sealing action.

Other structural details which would provide the required in-plane diaphragm flexibility include the use of a corrugated plate where the corrugations are normal to the resultant external force on a membrane panel as shown in FIGS. 25 to 26. For such a construction elastomeric seals may simply be replaced by a weld joint 70 between the corrugated plate 68 and the outer membrane shell 34.

A preferred detail is to have pipe beams 30 to help form the convex "corners" of the section and to carry the load from the concave sections 34. The design must also consider the case where an adjacent convex panel has ruptured due to ship impact or other cause thereby altering the normal loading on the pipe beam. A preferred detail is shown in FIG. 27.

A feature of the invention is that welds joining the convex corner shell (cover) plates 32 to the concave side shell plates 34 can be made utilising the pipe beam 30 as a backup. This will provide for simple fabrication as well as good structural design. It should be emphasised, however, that these single sided welds 72 made with a backup cannot be expected to be defect free and inspection of the reverse side will be impossible. For this reason welding imperfections must be allowed for in the design. In areas where inspection of the back of the weld is deemed necessary a built up area of weld 74, called a nib, can be provided by welding on the corner pipe 30 a raised portion of weld and then grinding it to provide a suitable weld preparation 76 as shown in FIG. 28. The outer membrane shell 34 is then brought up to the nib 74 and held in place by a temporary weld support 78 until the weld 80 is completed. Removal of the weld support 78 permits inspection of the rear 82 of the completed weld 80.

For a given pressure head and thickness of external shell plate there must be a certain minimum sag to span ratio in the shell in order to limit the membrane stress in the shell plate. It has been established that a minimum sag to span ratio of about 10% is necessary.

There exist an infinite variety of possibilities for using rectangles, octagons, and other shapes in various combinations for the hull pontoons and columns of TLP's or semisubmersibles. Some designs are better than others for particular applications. The general statement can be made that the more sides to the cross section the thinner the membrane shell plate can be made. This must be balanced, however, with the additional weight and cost of the corner pipe members and other internal framing.

Figure 29:
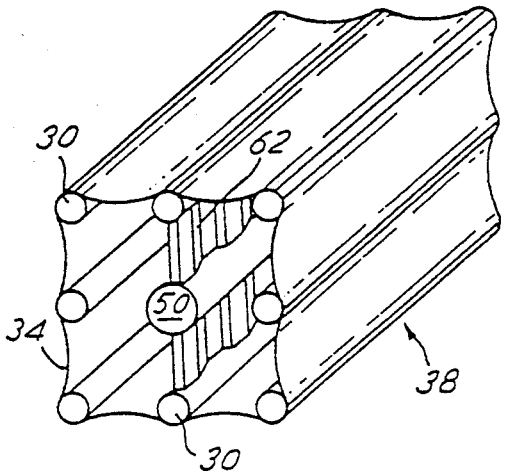
FIG. 29 represents a member suitable for use as the pontoon of FIG. 3.

The option shown below in FIG. 29 for a pontoon 38 illustrates a suitable compromise.

Figure 30:
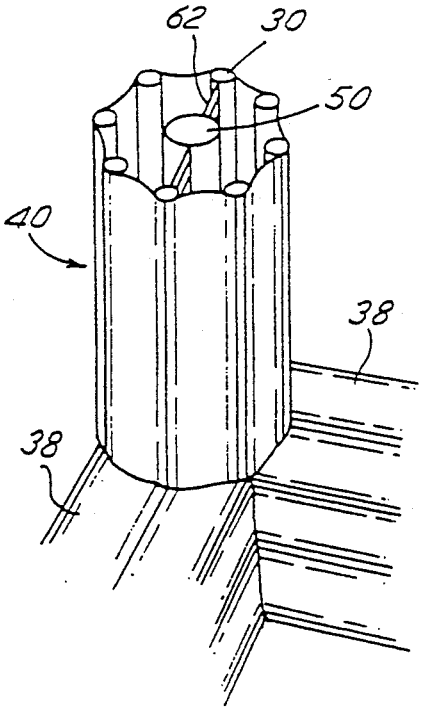
FIG. 30 represents a member suitable for use as the column of FIG. 3.

The choice of this shape is largely governed by the choice of on octagon shape for the columns 40 to which the pontoons will be framing. An octagon shape is a suitable choice for a column as shown in FIG. 30.

It can be seen that the corner pipe 30 can be placed such the pipes in the hull pontoons 38 frame directly into pipes from the columns 40. These pipe connections will be points of high stress concentration and will be designed as are the pipe nodes familiar in offshore platform (jacket) fabrication.

Figure 31:
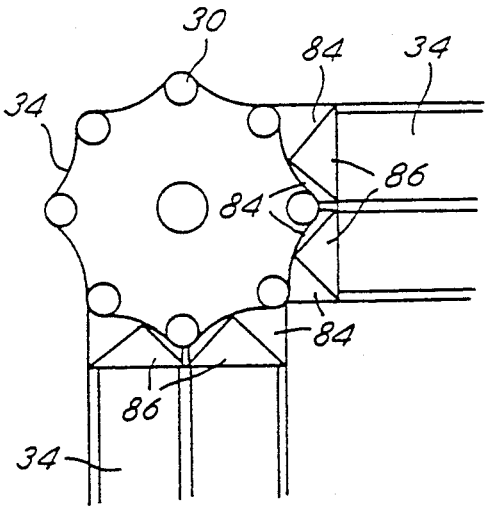

A proposed detail where the shell plating of the columns meets the shell plating of the pontoons is to gradually change from sagging membrane 34 to flat plate 84 so that the flat plate of the column joins to the flat plate of the pontoon. This is done by a transitional plate 86 in the form of a membrane shell having decreasing curvature along its length. Such transitional arrangements will be provided on the stub ends for both the pontoons and columns at the corner nodes. A suitable arrangement of this detail is shown in FIGS. 31 to 33. The detail shown in FIGS. 32 and 33 can also be used in subsea applications where it is necessary to close the ends of the structure. Transitioning to flat plate at the end of the element will allow welding at the corners to this flat plate.

Although the examples shown have been described with reference to prismatic elements having corner pipes which are straight and parallel, this does not preclude application of the invention to structures such as submarines which may require curved and/or non-parallel corner pipes. Whilst the majority of the examples described refer to floating vessels i.e. TLP's and semisubmersibles, it will be understood that there are many other areas where the framing invention described herein would provide advantages over current tecniques.

We claim:

1. A structural form comprising a hollow member having a shell with alternate concave and convex surfaces relative to the longitudinal axis of the member and an internal frame arrangement to support the shell, wherein the concave surfaces are unstiffened and run substantially the whole of the length of the member, the member being capable of resisting an applied external pressure loading, and said alternate concave and convex surfaces adjoining each other at a plurality of spaced locations on said shell and defining an outer peripheral surface of said shell, said outer peripheral surface having a smoothly curved configuration which is generally free of curvature discontinuities.

2. A member according to claim 1, characterized in that it is a prismatic element having longitudinally extending frame members disposed intermediate adjacent concave surfaces.

3. A member according to claim 2, characterized in that said shell includes alternate concave and convex shell portions which are joined together and are joined to the longitudinally extending frame members.

4. A member according to claim 1, characterized in that it is a prismatic element having straight, parallel elongate corner frame members which support said convex shell surfaces, and said shell having concave shell portions attached between respective pairs of said corner frame members.

5. A member according to claim 1, characterized in that the concave surfaces of said shell have a curvature only in a direction transverse to the longitudinal axis of the member.

6. A member according to claim 1, characterized in that the internal frame arrangement includes an elongate longitudinal stiffening member.

7. A member according to claim 1, characterized in that the internal frame arrangement includes a transverse bulkhead.

8. A member according to claim 1, characterized in that the internal frame arrangement includes a longitudinal bulkhead.

9. An elongate hollow structural member of generally polygonal cross-section having an internal support frame work and an outer shell comprising a plurality of adjacent elongate shell portions, wherein alternate shell portions of said plurality have a concave and convex surface respectively relative to the longitudinal axis of the member, each concave and convex surface running substantially the whole of the length of the member, and said alternate concave and convex surfaces adjoining each other at a plurality of spaced locations on said shell and defining an outer peripheral surface of said shell, said outer peripheral surface having a smoothly curved configuration which is generally free of curvature discontinuities.

10. A member according to claim 9, characterised in that it is a prismatic element having longitudinally extending frame members disposed intermediate adjacent concave surfaces.

11. A member according to claim 10, characterised in that said alternate concave and convex shell portions are joined together and are joined to the longitudinally extending frame members.

12. A member according to claim 9, characterised in that it is a prismatic element having straight, parallel elongate corner frame members which support said convex shell surfaces, and having said concave shell portions attached between respective pairs of said corner frame members.

13. A member according to claim 9, characterised in that the concave shell portions have a curvature only in a direction transverse to the longitudinal axis of the member.

14. A member according to claim 9, characterised in that the internal support frame work includes an elongate longitudinal stiffening member.

15. A member according to claim 9, characterised in that the internal support frame work includes a transverse bulkhead.

16. A member according to claim 9, characterised in that the internal support frame work includes a longitudinal bulkhead.

17. An elongate hollow structural member of generally polygonal cross-section having an internal support frame work and an outer shell comprising a plurality of adjacent elongate shell portions, wherein alternate shell portions of said plurality have a concave and convex surface respectively relative to the longitudinal axis of the member, each concave and convex surface running substantially the whole of the length of the member, said alternate concave and convex surfaces adjoining each other at a plurality of spaced locations on said shell and defining an outer peripheral surface of said shell, said outer peripheral surface having a smoothly curved configuration which is generally free of curvature discontinuities, said member being an external pressure vessel for forming one of a pontoon element and a column element of a floating structure.

18. A semisubmersible floating structure, comprising: one of a hull pontoon and a deck support column which includes a hollow member having a shell with alternate concave and convex surfaces relative to the longitudinal axis of the member and an internal frame arrangement to support the shell, said alternate concave and convex surfaces adjoining each other at a plurality of spaced locations on said shell and defining an outer peripheral surface of said shell, said outer peripheral surface having a smoothly curved configuration which is generally free of curvature discontinuities, wherein the concave surfaces are unstiffened and run substantially the whole of the length of the member, the member being capable of resisting an applied external pressure loading.

19. A method for producing a structural form which is a hollow member capable of resisting applied external pressure loading, which method comprises providing a shell with alternate concave and convex surfaces relative to the axis of the member, said alternate concave and convex surfaces adjoining each other at a plurality of spaced locations on said shell and defining an outer peripheral surface of said shell, said outer peripheral surface having a smoothly curved configuration which is generally free of curvature discontinuities, and providing an internal framing arrangement to support the shell, characterised by the use of unstiffened concave surfaces along substantially the whole of the length of the member.

20. A structural form comprising a hollow member having a shell with alternate concave and convex surfaces relative to the longitudinal axis of the member and an internal frame arrangement to support the shell, said alternate concave and convex surfaces adjoining each other at a plurality of spaced locations on said shell and defining an outer peripheral surface of said shell, said outer peripheral surface having a smoothly curved configuration which is generally free of curvature discontinuities, wherein the concave surfaces are unstiffened and run substantially the whole of the length of the member, the member being capable of resisting an applied external pressure loading, said member being an external pressure vessel for forming one of a pontoon element and a column element of a floating structure.

21. A semisubmersible floating structure, comprising: one of a hull pontoon and a deck support column which includes an elongate hollow structural member of generally polygonal cross-section having an internal support frame work and an outer shell comprising a plurality of adjacent elongate shell portions, wherein alternate shell portions of said plurality have a concave and convex surface respectively relative to the longitudinal axis of the member, said alternate concave and convex surfaces adjoining each other at a plurality of spaced locations on said shell and defining an outer peripheral surface of said shell, said outer peripheral surface having a smoothly curved configuration which is generally free of curvature discontinuities, each concave and convex surface running substantially the whole of the length of the member.

* * * * *